US007905044B2

(12) United States Patent
Clouser

(10) Patent No.: US 7,905,044 B2
(45) Date of Patent: Mar. 15, 2011

(54) SIGHTING SYSTEM

(76) Inventor: Roger Clouser, Baldwin City, KS (US)

( * ) Notice: Subject to any disclaimer, the term of this patent is extended or adjusted under 35 U.S.C. 154(b) by 0 days.

(21) Appl. No.: 12/869,606

(22) Filed: Aug. 26, 2010

(65) Prior Publication Data

US 2010/0319234 A1 Dec. 23, 2010

Related U.S. Application Data

(63) Continuation of application No. 11/555,007, filed on Oct. 31, 2006.

(51) Int. Cl.
*F41G 1/38* (2006.01)

(52) U.S. Cl. ..... 42/122; 42/111; 42/130

(58) Field of Classification Search ..... 42/130, 42/111, 122, 113, 144; D22/108, 110
See application file for complete search history.

(56) References Cited

U.S. PATENT DOCUMENTS 2,430,469 A * 11/1947 Karnes ..... 42/145

* cited by examiner

*Primary Examiner* — Stephen M Johnson
*Assistant Examiner* — Daniel J Troy
(74) *Attorney, Agent, or Firm* — Hovey Williams LLP

(57) ABSTRACT

A sighting assembly is configured for use on a firearm in long-range sighting applications and broadly comprises proximal and distal sights. The sights present various sighting surfaces including at least a pair of complemental surfaces that, when viewed along a sighting direction, are opposed to one another. The distal sight presents a radially outer one of the opposed sighting surfaces and the proximal sight presents a radially inner one of the opposed sighting surfaces. The opposed surfaces cooperatively present at least one aiming window for accurately aligning the sights and viewing a target.

6 Claims, 4 Drawing Sheets

6.

6.

SIGHTING SYSTEM

RELATED APPLICATION

This is a continuation of prior application Ser. No. 11/555,007, filed Oct. 31, 2006, entitled SIGHTING SYSTEM, which is hereby incorporated in its entirety by reference herein.

BACKGROUND OF THE INVENTION

1. Field of the Invention

The present invention relates generally to sighting systems for precisely aligning a device, such as a firearm or telescope, with a target. More specifically, embodiments of the present invention concern a firearm sighting system with proximal and distal sights that present a sight picture when viewed with complementally shaped surfaces.

2. Discussion of Prior Art

Metallic gun sights, also known as "iron sights," are known in the art. Prior art metallic gun sights include peep sights and open sights. Both peep sights and open sights utilize a proximal or rear sight, i.e., nearest the user's eye, in cooperation with a distal or front sight, i.e., spaced along the firearm in a direction away from the user. Peep sights generally have an aperture in the rear sight and the front sight commonly includes a blade, a post and bead, a circle, or a circle and insert. The rear aperture is typically positioned close to the shooter's eye, which in the sight picture surrounds, and is larger than, the front sight. Open sights traditionally are post and notch, where the front sight is a post or blade and the rear sight includes a blade with a notch. The rear sight in open sights is typically viewed from a distance in operation.

All prior art metallic gun sights, including peep sights and open sights, are problematic and subject to several undesirable limitations. For example, open sights and peep sights lack precision for fine accuracy. The aiming references of open sights are limited to the two symmetrical blocks of light in the rear sight on either side of the front sight post, and the alignment of the top edges of the front blade with the rear sight. Peep sights include a rear sight with an aperture close to the shooter's eye, wherein the user looks through the aperture to view the front sight. Typically when viewed, the aperture provides a much larger sighting surface that encircles a relatively small sighting surface of the front sight. The substantial radial spacing between the sights when viewed provides an aiming reference that is imprecise. Furthermore, the centering of the front bead or blade inside the rear sight aperture provides the only aiming reference between the two sights.

Another limitation of prior art sights, including open sights and peep sights, is that they obscure the target during aiming. With respect to open sights, the user must cut the target, such as a black circle bulls eye, in half with the rear blade in order to aim at the center of the target. The solid rear blade necessarily obscures the user's view of at least half of the target when aiming perfectly at the center. The rear blade also obscures the target when the user has not yet acquired the target, e.g., where the target is spaced below the upper edge of the blade. The alternative method of aiming with an open sight is to float the entire target above the blade, which is an inherently imprecise way of aiming at the center of the target. Similarly, the rear sight of a peep sight commonly has large eye discs and relatively bulky metal close to the shooter's eye and face. During aiming, the rear sight substantially blocks the user's view of the target area except for the aperture. Thus, a rear sight obscures the target, particularly when the user has not yet acquired the target.

Yet another limitation of prior art sights is that the rear sight obscures the front sight. For example, the rear sight of an open sight necessarily obscures a large portion of the front sight when the sights are perfectly aligned. Prior to perfect alignment, the rear sight can easily entirely block the user's view of the front sight. Similarly, the rear sight of a peep sight can also obscure the front sight prior to alignment of the sights.

As mentioned, prior art rear sights, such as those of an open or peep sight, block a substantial part of the user's view. Consequently, prior art rear sights do not allow sufficient light to pass through to the user, particularly in low light conditions.

Thus, all prior art metallic gun sights continue to suffer from several basic problems: the sight picture to the shooter does not provide precise aiming references, prior art sights obscure the target and surrounding target areas, the rear sight obscures the front sight, and target acquisition is poor in low light. These limitations of prior art sights also tend to slow target acquisition. Accordingly, there is a need for an improved sighting system.

SUMMARY OF THE INVENTION

The present invention provides a sighting assembly that does not suffer from the problems and limitations of the prior art gun sights set forth above.

A first aspect of the present invention concerns a firearm sighting assembly for facilitating aiming of a firearm at a target by a user. The firearm sighting assembly broadly includes proximal and distal sights configured for connection to the firearm to sight the target along a sighting direction. The proximal sight is connectable to the firearm closer to the user along the sighting direction than the distal sight. The distal sight presents a generally inward facing distal sighting surface that defines an opening. The proximal sight presents a generally outward facing proximal sighting surface. The proximal sighting surface is spaced within the opening when the target is viewed with the sights, such that the sighting surfaces present corresponding opposed sections when viewed. The proximal and distal sighting surfaces present respective radial dimensions measured relative to the sighting direction. The proximal sighting surface is radially smaller than the distal sighting surface along the corresponding opposed sections.

A second aspect of the present invention concerns a firearm assembly operable by a user to aim at a target. The firearm assembly broadly includes a firearm and a firearm sighting assembly. The firearm includes a muzzle end. The firearm sighting assembly facilitates aiming of the firearm at the target. The firearm sighting assembly includes proximal and distal sights connected to the firearm to sight the target along a sighting direction, with the distal sight being spaced closer to the muzzle end than the proximal sight. The distal sight presents a generally inward facing distal sighting surface that defines an opening. The proximal sight presents a generally outward facing proximal sighting surface. The proximal sighting surface is spaced within the opening when the target is viewed with the sights, such that the sighting surfaces present corresponding opposed sections when viewed. The proximal and distal sighting surfaces present respective radial dimensions measured relative to the sighting direction. The proximal sighting surface is radially smaller than the distal sighting surface along the corresponding opposed sections.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 15:
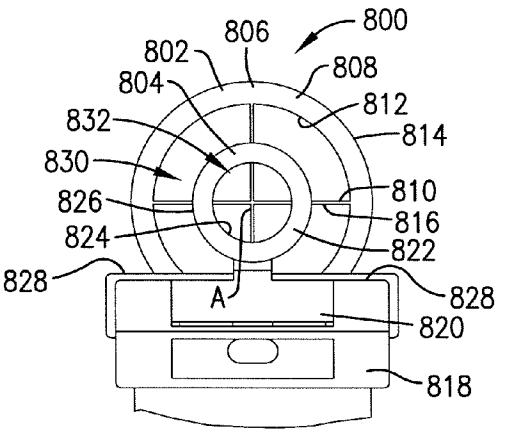
Figure 16:
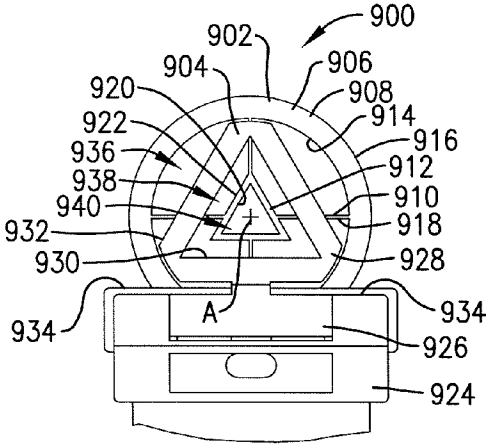

FIG. 15 is a rear elevational view of a sighting assembly constructed in accordance with a eighth embodiment of the present invention and shown mounted on a handgun (shown in fragmentary) and illustrating a sight picture provided when viewing the sighting assembly along a sighting direction in order to aim the handgun at a target (not shown); and FIG. 16 is a rear elevational view of a sighting assembly constructed in accordance with a ninth embodiment of the present invention and shown mounted on a handgun (shown in fragmentary) and illustrating a sight picture provided when viewing the sighting assembly along a sighting direction in order to aim the handgun at a target (not shown).

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
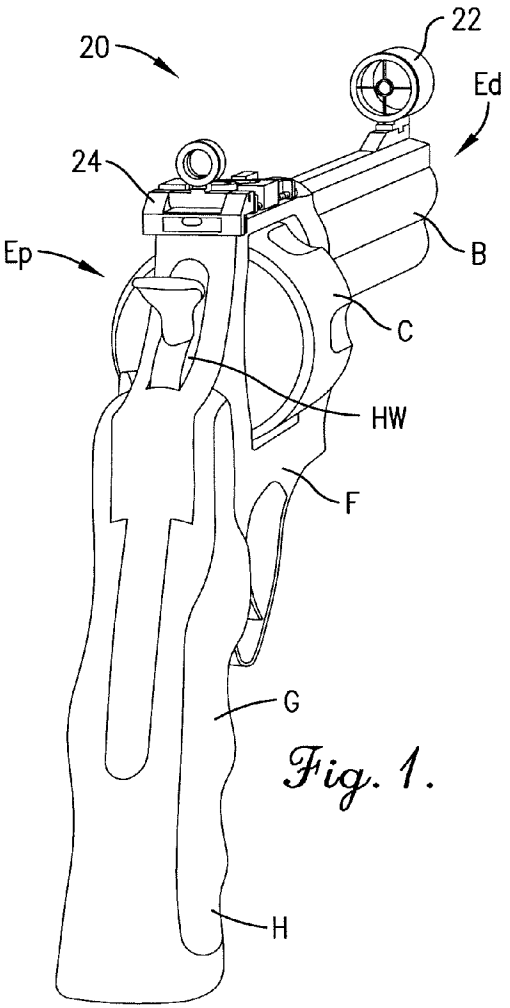
FIG. 1 is a rear perspective view of a sighting assembly constructed in accordance with a preferred embodiment of the present invention and shown mounted on a revolver-type handgun with a proximal sight of the sighting assembly positioned for short range use.

FIG. 1 illustrates a sighting assembly 20 constructed in accordance with a preferred embodiment of the present invention and configured for mounting on a handgun H. As will be further detailed below, the illustrated sighting assembly 20 is particularly well suited for facilitating target acquisition in relatively long range applications where precise accuracy is valued. One such application is competitive long range target shooting, such as traditional bulls eyes at distances as far as one-thousand yards. Accordingly, the handgun H illustrated in FIG. 1 is suitable for such applications, such as a large caliber handgun. However, the principles of the present invention are not limited to any particular type of firearm and would equally apply to any weapon where a metal sight is utilized, such as a civilian or military handgun, rifle, shotgun, crossbow and the like. Furthermore, while the principles of the present invention are well suited for metallic gun sight applications, they can be equally applied to any device that needs to be precisely aligned with a location, such as a telescope.

The illustrated handgun H is a conventional Smith and Wesson revolver-type handgun and broadly includes a frame F, a grip G, a barrel B coupled to the frame F, and hardware HW associated with the frame F for firing ammunition through the barrel B. The frame F, barrel B, and hardware HW comprise the traditional components of any conventional handgun and accordingly will not be described in detail herein with the understanding that these components could be variously configured in any manner well known in the art. The illustrated hardware HW includes a revolving, multiple-chamber cylinder C with a hammer and trigger firing mechanism. The handgun H also presents a distal end Ed (i.e., the muzzle end of the handgun H spaced distally from the user) and a proximal end Ep (i.e., the breech end of the handgun H spaced proximally to the user).

Figure 2:
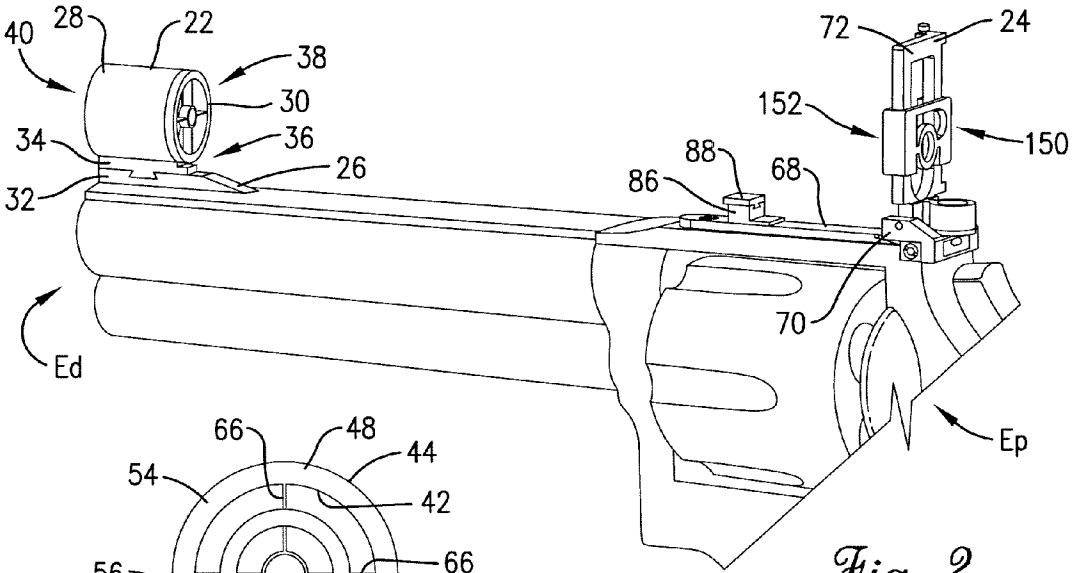
FIG. 2 is side perspective view of the sighting assembly shown in FIG. 1, showing the sighting assembly mounted on the handgun and illustrating a staff of the proximal sight in an upright sighting position for long range use.
Figure 6:
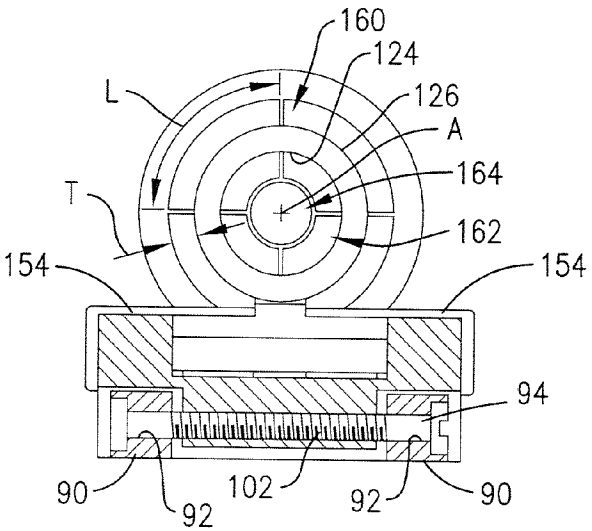
FIG. 6 is a sectional view of the sighting system taken substantially along line 6-6 of FIG. 5, showing a windage platform and a sight base of the proximal sight being attached to one another by a windage screw.
Figure 7:
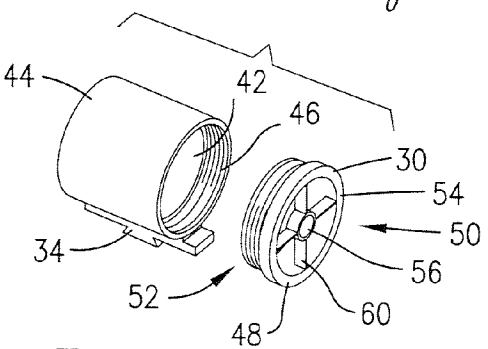
FIG. 7 is an exploded perspective view of a distal sight of the sighting assembly shown in FIGS. 1-6, showing a threaded insert removed from the remainder of the distal sight.
Figure 4:
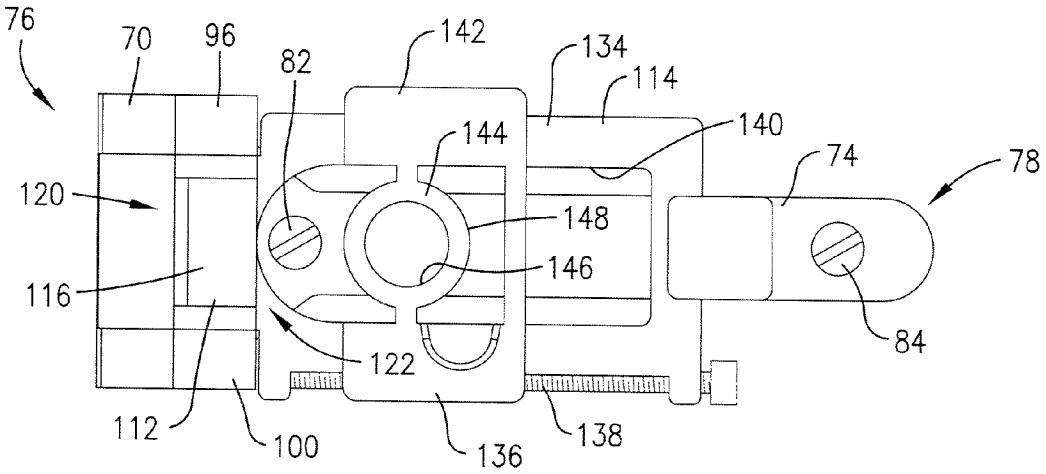
FIG. 4 is a plan view of the proximal sight of the sighting assembly shown in FIGS. 1-3, showing a shiftable sight element of the proximal sight slidably mounted on the staff.
Figure 5:
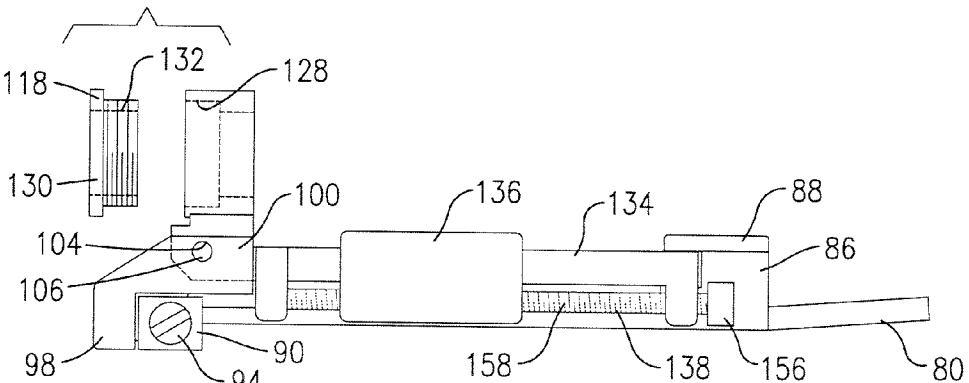
FIG. 5 is a fragmentary side elevational view of the proximal sight shown in FIGS. 1-4, showing a threaded insert removed from the remainder of the proximal sight.

Turning now to FIGS. 1-7, the inventive sighting assembly 20 is configured to provide superior accuracy, faster target acquisition, and improved low light capability for a shooter aiming the firearm H at a target and broadly includes a muzzle sight 22 and a breech sight 24. Perhaps as best shown in FIGS. 1, 2, and 7, the illustrated muzzle sight 22 broadly includes a base 26, a body 28 coupled to the base 26, and an insert 30 removably coupled to the body 28. The muzzle sight 22 is preferably comprised of SAE 4140 carbon steel. However, it is within the ambit of the present where the muzzle sight 22 is manufactured from other carbon steels, aluminum, stainless steel, or other suitable metallic or non-metallic materials.

In more detail, the base 26 is configured to mount on the handgun H atop the distal end Ed of the barrel B. In one manner well known in the art, the base 26 is attached to a ramp portion 32 of the barrel B and includes an inset portion 34 that is coupled to the ramp portion 32. Each of the portions 32,34 include dovetail surfaces that are complementally shaped so as to be in interlocking engagement with one another. While the ramp portion 32 is preferably integrally formed with the barrel B, the principles of the present invention are applicable where the ramp portion 32 is otherwise affixed thereto, such as with screws, pins, weldment, or the like. The inset portion 34 interlocks with the ramp portion 32 and once interlocked, could be removably coupled thereto (e.g., by a press fit or pinned joint) or permanently coupled thereto (e.g., by a weldment). The illustrated inset 34 includes a stepped setoff 36 adjacent a proximate end of the inset portion 34. The base 16 could be variously alternatively configured in any suitable manner known in the art. For example, the base 26 need not be a two-piece configuration. Additionally, the base 26 could be eliminated altogether, such as affixing the body 28 directly to the barrel B. However, if a base 26 is utilized, the base 26 is preferably coupled to the handgun H centered atop the barrel B adjacent the distal end Ed.

The body 28 is coupled to the base 26 and is configured to receive the insert 30 to cooperatively present proximal and distal open ends 38,40 of the muzzle sight 22 and internal and external sighting surfaces 42,44 that are preferably substantially coaxial between the ends 38,40. As will be discussed, the surfaces 42,44 are configured for sighting a target. In more detail, the illustrated body 28 is preferably cylindrical and includes internal threads 46 adjacent the proximal end 38. The insert 30 includes a cylindrical body 48 and presents a proximal end 50 and an externally threaded distal end 52. While the bodies 28,48 are preferably cylindrical and, therefore, have a circular cross section, it is also within the ambit of the present invention where the bodies 28,48 have a cross section comprising other geometrical shapes, e.g., a semicircle, a polygon, or another suitable shape. Adjacent the end 50, the insert 30 includes an outer circular element 54, an inner circular element 56, and cross hair portions 60 that are integrally formed with the body 48. The inner element 56 is spaced within the outer circular element 54, with cross hair portions 60 interconnecting the inner circular element 56 and the outer circular element 54.

The inner circular element 56 presents internal and external sighting surfaces 62,64, which are preferably coaxial. The cross hair portions 60 present sighting surfaces 66. Similar to surfaces 42,44, surfaces 62,64,66 are configured for sighting a target. As will be discussed in greater detail, surfaces 42,44, 62,64,66 cooperate with surfaces of the breech sight 24 to define a sight picture of the sighting assembly 20, i.e., a user's view of the silhouette formed by the sighting assembly 20 when aiming the handgun H at the target.

The insert 30 is threadably inserted within the body 28 so that the threaded distal end 52 is received by the internal threads 46. The thickness of the outer circular element 54 is substantially the same as the thickness of the barrel-shaped body 28. However, the principles of the present invention are equally applicable where the outer circular element 54 is thicker than the body 28 so as to present a correspondingly thicker circular silhouette form for the muzzle sight 22. In this manner, the muzzle sight 22 is adjustable to accommodate several variables such as environmental conditions (e.g., lighting or terrain) and the user's visual acuity.

The illustrated breech sight 24 is a flip-up sight and is mounted adjacent the proximal end Ep. The breech sight 24 broadly includes an adjustable sight base 68, a windage platform 70, and a shiftable dual sight 72. The sight base 68 is preferably comprised of spring steel and the remainder of the breech sight 24 is preferably comprised of SAE 4140 carbon steel. However, it is within the ambit of the present where the breech sight 24 is manufactured from other carbon steels, aluminum, stainless steel, or other suitable metallic or non-metallic materials.

Turning to FIGS. 4-7, the sight base 68 includes an elongated bracket 74 with proximal and distal ends 76,78. The bracket 74 includes an angled tab 80 adjacent the distal end 78. Again, the bracket 74 is preferably made of spring steel and is, therefore, is elastically bendable. The bracket 74 further includes proximal and distal screws 82,84 received in corresponding holes (not shown) in the bracket 74 and which secure the bracket 74 to the handgun H. The distal screw 84 is threaded into the handgun H to position the angled tab 80 firmly against the handgun H. Preferably, the distal screw 84 is threaded fully into the handgun H. However, it is consistent with the principles of the present invention where the distal screw 84 is adjustably threaded into the handgun H.

The proximal screw 82 is preferably adjustable to position the proximal end 76 vertically relative to the handgun H. With the proximal screw 82 removed and the distal screw 84 installed, the proximal end 76 is spaced from an uppermost surface of the handgun H, due to the configuration of the angled tab 80. The installation of proximal screw 82 permits the proximal end 76 to be vertically repositioned at a distance from the uppermost surface from about zero inches to about 3/16 inch. The construction of the bracket 74 with spring steel permits the bracket 74 to elastically bend as the proximal screw 82 is threaded into the handgun H. As will be discussed, vertical positioning of the screw 82 permits selective vertical positioning of the dual sight 72.

The sight base 68 further includes a pedestal 86 integrally formed with the bracket 74 adjacent the distal end 78 and a catch 88 slidably attached to an uppermost surface of the pedestal 86 (see FIG. 2). The sight base also includes bosses 90 adjacent the proximal end 60 (see FIG. 6), with coaxial holes 92 therethrough, and a windage screw 94 rotatably received within the holes 92 and configured to position the windage platform 70, as will be discussed.

The windage platform 70 includes a body 96 that presents a lower base 98 and connectors 100 projecting from the base 98. The lower base 98 includes a threaded through-hole 102 for receiving the windage screw 94, as will be discussed. Coaxial holes 104 extend through the connectors 100 to receive a pin 106. The windage platform 70 further includes a spirit level 108 attached to and spaced within the body 96. The spirit level 108 is similar to those known in the art and, in the usual manner, includes an outer shell preferably comprising a high-impact cast acrylic and contains a liquid and a gas bubble 110 floating in the liquid (see FIG. 3). The spirit level 108 indicates orientation of the handgun H and is particularly suitable for repetitively positioning the handgun H prior to firing. It has been determined that such repeatability in firearm positioning is critical for maintaining accuracy in long range shooting applications, particularly with a handgun such as the illustrated handgun H.

The windage platform 70 is attached to the sight base 68 by extending the windage screw 94 through coaxial holes 92 and through-hole 102. The windage screw 94 includes external threads that engage the internal threads of the through-hole 102. Rotational movement of the windage screw 94 shifts the windage platform 70 relative to the sight base 68 laterally along the axis of the windage screw 94 and between the bosses 90.

The dual sight 72 broadly includes a short-range sight 112 and a long-range sight 114 integrally attached to one another. The short-range sight 112 comprises a cylindrical body 116 similar to the body 28 and an insert 118. The body 116 and insert 118 cooperatively present proximal and distal open ends 120,122 and internal and external sighting surfaces 124, 126 that preferably substantially extend coaxially between the ends 120,122. As will be discussed, the surfaces 124,126 are configured for sighting a target and present a substantially circular silhouette form that is configured to define part of the sight picture of the sighting assembly 20.

The body 116 is cylindrical and includes internal threads 128 adjacent the proximal end 120. The insert 118 is unitary and includes a circular element 130 and a threaded element 132. The insert 118 is threadably inserted within the body 116. In the illustrated embodiment, the thickness of the circular element 130 is substantially the same as the thickness of the cylindrical body 116. However, the principles of the present invention are equally applicable where the circular element 130 is thicker than the body 116 so as to present a correspondingly thicker silhouette form for the breech sight 24. In this manner, the breech sight 24 is adjustable to accommodate variable conditions as discussed previously with respect to the muzzle sight 22.

The long-range sight 114 preferably includes a staff 134, a shiftable sight 136, and an elevation screw 138. The staff 134 is a preferably unitary metallic plate and presents an opening 140. The sight 136 is also preferably a unitary metallic plate and comprises a U-shaped frame 142 and a circular element 144 that is preferably fixed to and spaced within the frame 142. The circular element 144 preferably includes internal and external sighting surfaces 146,148 that coaxially extend between proximal and distal ends 150,152 of the circular element (see FIG. 2). Similar to surfaces 124,126, surfaces 146,148 are also configured for sighting a target and present a substantially circular silhouette form that is configured to define part of the sight picture of the sighting assembly 20.

In addition, the shiftable sight 136 and windage platform 70 present other sighting surfaces 154 (see FIG. 6). However, the principles of the present invention are applicable where other portions of the sighting assembly 10 present sighting surfaces for sighting a target.

The sight 136 is preferably slidably mounted on the staff 134. The elevation screw 138 includes a head 156 and a screw body 158 and is rotatably mounted on the staff 134. The screw 138 also extends through a threaded bore (not shown) of the sight 136. Thus, as the head 156 is rotated the sight 136 is shifted by the screw 138 in the corresponding direction along the staff 134.

As previously mentioned, the short-range sight 112 is integrally fixed to the long-range sight 114. In particular, the short-range sight 112 generally extends at a right angle to the long-range sight 114, so that only one of the sights 112,114 is configured for use at a particular time.

The dual sight 72 is shiftably attached to the sight base 68 by the pin 106. The dual sight 72 is shiftable relative to the sight base 68 about an axis of the pin 106 to position either the short-range sight 112 or the long-range sight 114 into an upright sighting position. When the short-range sight 112 is placed into the upright sighting position (see FIG. 5), the long-range sight 114 is shifted into a lowered position and extends laterally along the bracket 74, i.e., the short-range sighting configuration. Furthermore, the dual sight 72 is secured in this lowered position by shifting the catch 88 rearwardly into a staff engagement position (shown in FIG. 5). To permit shifting of the short-range sight 112 out of the first sighting position, the catch 88 is configured to shift forwardly (as shown in FIG. 2). Subsequently, the dual sight 72 is rotatable about the pin 106 in a generally rearward direction until the short-range sight 112 contacts the windage platform 70 and the long-range sight 114 is placed into the upright sighting position, i.e., a long-range sighting configuration. In the long-range configuration, the dual sight 72 is preferably frictionally held in place.

For relative lateral shifting between the sights 22,24, i.e., windage adjustment, the windage platform 70 and windage screw 94 cooperate to shift the dual sight 72 relative to the sight base 68. Thus, as the windage screw 94 is rotated, the windage platform 70 shifts relative to the sight base 68 laterally along the axis of the windage screw 94. Consequently, the dual sight 72 is shifted by the windage platform 70 along the lateral axis and relative to the muzzle sight 22.

As previously discussed, the sight base 68 is vertically adjustable by adjustment of the proximal screw 82. Thus, in order to adjust the vertical position of the short-range sight 112 relative to the muzzle sight 22, the proximal screw 82 is repositioned accordingly while the screw 84 remains fully threaded in the handgun H. For example, in order to raise the short-range sight 112, the proximal screw 82 is threaded out of the handgun H and the distal screw 84 remains threaded in the handgun H.

For vertical adjustment of the long-range sight 114, the sight base 68 can be repositioned by adjustment of the screw 82 as discussed. In addition, the shiftable sight 136 can be vertically adjusted by rotating the elevation screw 138. Thus, either of the sights 112,114 are adjustable both vertically and laterally relative to the muzzle sight 22.

Figure 3:
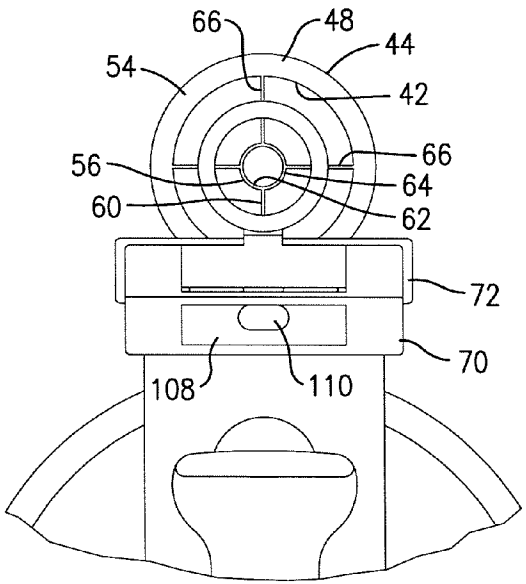
FIG. 3 is a rear elevational view of the sighting assembly shown in FIGS. 1 and 2, showing the staff in a lowered position and illustrating a sight picture provided when viewing the sighting assembly along a sighting direction in order to aim the handgun at a target (not shown)

Turning to FIGS. 3 and 6, the sights 22,24 cooperatively form the illustrated sight picture when viewing the sighting assembly along a sighting direction or sighting axis A. As discussed previously, various sighting surfaces 42,44,62,64, 66,124,126,146,148,154 are configured for sighting a target by presenting a sight picture. The sighting surfaces 42,44,62, 64,66,124,126,146,148,154 present various radial dimensions when measured from the sighting axis A. Preferably, at least some of the sighting surfaces 42,44,62,64,66,124,126, 146,148,154 present corresponding opposed sections when the target is viewed along the sighting axis A with the sights 22,24. More preferably, the opposed surface sections are preferably geometrically symmetrical with one another and are uniformly spaced apart. For example, arcuate sections of surfaces 42,126 that are adjacent to one another are both uniform circular arcs and are spaced from one another at a uniform radial distance measured from the sighting axis A. Most preferably, opposed surface sections are substantially coaxial to one another when viewed along the sighting axis A.

Preferably, surfaces 42,126 and surfaces 64,124 are also opposed to one another when a target is viewed along the sighting axis A with the short-range sight 112 in the upright sighting position. Surfaces 42,148 and surfaces 64,146 are also opposed to one another when a target is viewed along the sighting axis A with the long-range sight 114 in the sighting position. Again, the principles of the present invention are applicable where other portions of the sighting assembly 20 present sighting surfaces for sighting a target.

When a target is viewed along the sighting axis A with the short-range sight 112 in the upright sighting position, the sighting surfaces 42,66,126,154 preferably cooperatively form a plurality of outer aiming windows 160, and sighting surfaces 64,66,124 preferably cooperatively form a plurality of inner aiming windows 162. When the target is viewed along the sighting axis A with the long-range sight 114 in the upright sighting position, sighting surfaces 42,66,148,154 preferably cooperatively form the outer aiming windows 160, and sighting surfaces 64,66,146 preferably cooperatively form the inner aiming windows 162. Furthermore, a central aiming window 164 is defined by the internal sighting surface 50*b*. The term aiming window, as used herein, refers to one or more sighting surfaces that entirely bound, i.e., that form a boundary around, a continuous viewing space as the sighting surface(s) are viewed along a sighting direction. Furthermore, aiming windows 160,162 are compound aiming windows. The term compound aiming window, as used herein, refers to two or more sighting surfaces that entirely bound and thereby define a continuous viewing space as the sighting surfaces are viewed along a sighting direction. While the illustrated embodiment preferably includes various aiming windows, it is also within the ambit of the present invention where other types of openings or apertures are formed by one or more of the above referenced sighting surfaces.

Thus, the sights 22,24 preferably present a sight picture or silhouette form comprising three (3) substantially concentric circles. Furthermore, the sight picture includes perpendicular cross hairs that extend from the outermost circle to the innermost circle. More preferably, the breech sight 24 provides the intermediate circle of the three circles. That is, the muzzle sight 22 presents the innermost and outermost circles with the breech sight 24 presenting a circle that is spaced within the outermost circle and itself encircles the innermost circle. This configuration of sighting surfaces between the sights 22,24 provides a highly animated sight picture, i.e, a sight picture that attracts the user's attention. While the illustrated embodiment preferably includes these coaxial geometric surfaces, the principles of the present invention are equally applicable where the sighting assembly 20 includes other forms and configurations of geometric surfaces.

In the illustrated embodiment, an upper pair of the aiming windows 160, all of the aiming windows 162, and central aiming window 164 each have an corresponding axis of symmetry about which the respective aiming window 160,162, 164 is symmetrical. Also, the upper pair of aiming windows 160, the lower pair of aiming windows 162, as well as any pair of the aiming windows 162 are each symmetrical with respect to one another. The uniformity of the aiming windows 106, 162,164 and the concentric arrangement of geometrical shapes permits a vivid sight picture while minimally visually obstructing the user's view of the intended target. In other words, the large number of aiming windows 160,162,164 and their proximity to one another effectively provide pixel-type blocks of light or segmented views of the target that a user can visually synthesize into a collective view of the target. While the illustrated embodiment preferably includes aiming windows 160,162,164 to create this vivid sight picture, the principles of the present invention are applicable where a large number of other types of apertures or openings are grouped together to provide a sight picture.

Furthermore, the use of concentric, closely-spaced sighting surfaces creates narrow aiming windows that precisely indicate any misalignment of the sights 22,24 to the user. For example, the aiming windows 160,162,164 present an unobstructed space for viewing a target with at least one window thickness dimension transverse to any axis of misalignment. For example, in the illustrated embodiment, window 160 presents a window length L and a window thickness T. Preferably, the thickness dimension T is shorter than the length dimension L of the window 160,162,164, although the principles of the present invention are applicable where the thickness has the same or larger dimension than the length. For a compound aiming window, as discussed above, such a thickness dimension decreases in length as misalignment about the axis increases. As the thickness dimension of the aiming window during perfect alignment is made smaller, slight changes in the thickness dimension due to misalignment become more visually pronounced. Therefore, the illustrated sighting assembly 10 is preferably designed with narrow compound aiming windows that provide a noticeable visual indication of even slight misalignment between sights 22,24.

While the sighting assembly 20 does not include optical magnification therein, the principles of the present invention are applicable where a magnification lens is included in one or both of the sights 22,24 either permanently, e.g., within the respective body 28,116,144 or selectively, e.g., as part of the corresponding insert 30,118.

In operation, the handgun H is preferably held by a user so that the illustrated sighting assembly 20 is positioned from the user at a sight relief distance of about eighteen (18) inches. The sight relief distance is the distance from the user's eye to the most proximal sight, i.e., the breech sight 24. The user can selectively shift the dual sight 72 into either a long-range or short-range configuration (i.e., with either the long-range sight 114 or the short-range sight 112 in the upright sighting position). The sights 22,24 are configured to be viewed so as to be coaxial with one another to define the sighting axis A and thereby provide a sight picture as discussed above. The spirit level 108 is operable to provide an indication of handgun orientation to the user.

Turning to FIGS. 8-16, alternative preferred embodiments of the present invention are depicted. For the sake of brevity, the remaining description will focus primarily on the differences of these alternative embodiments from the preferred embodiment described above.

Figure 9:
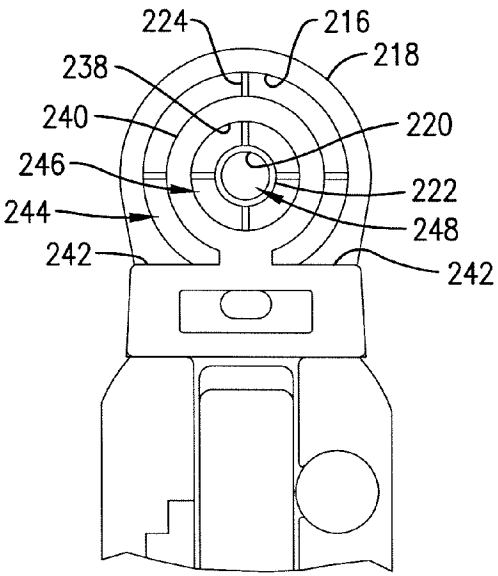
FIG. 9 is a rear elevational view of the sighting assembly shown in FIG. 8, showing a sight picture provided when viewing the sighting assembly along a sighting direction in order to aim the handgun at a target (not shown)
Figure 8:
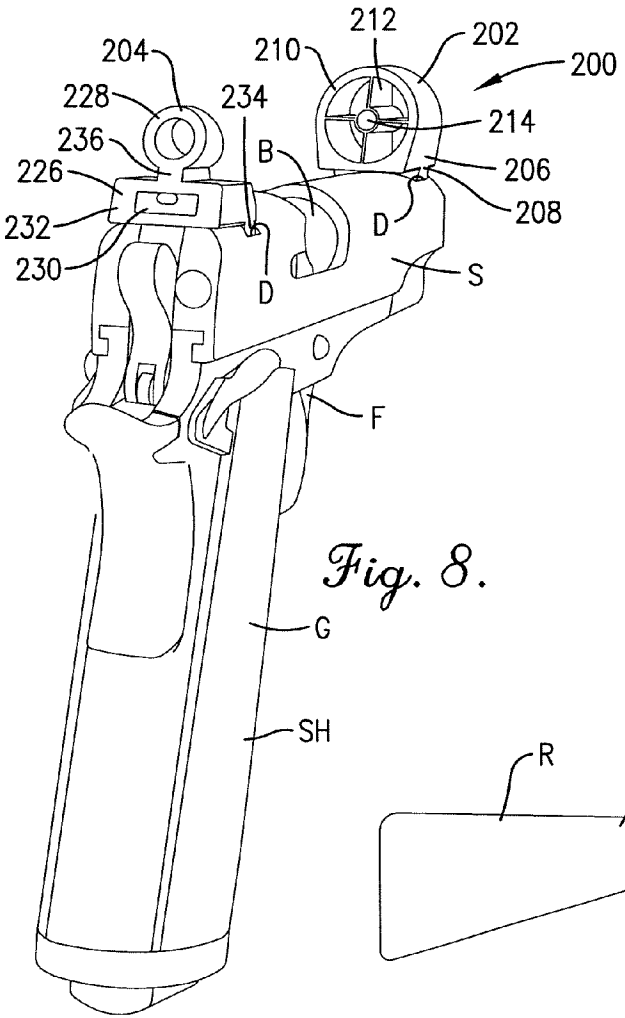
FIG. 8 is a rear perspective view of a sighting assembly constructed in accordance with a second embodiment of the present invention and shown mounted on a semiautomatic handgun.

Initially turning to FIGS. 8 and 9, an alternative sighting assembly 200 is constructed in accordance with a second embodiment of the present invention. The illustrated sighting assembly 200 is mounted onto a semiautomatic handgun SH. The illustrated handgun SH is a semiautomatic M1911 government model. It is also within the ambit of the present invention where the sighting assembly 200 is used on firearms other than the handgun SH. The handgun SH includes a grip G, frame F, barrel B, and slide S. The slide S presents a pair of dovetail grooves D that extend transversely to the length of the barrel B.

The sighting assembly 200 broadly includes an alternative muzzle sight 202 and an alternative breech sight 204. The muzzle sight 202 includes a substantially unitary body 206. The body 206 presents a dovetail-shaped base element 208 that interlocks with the complemental dovetail groove D. The body 206 also preferably includes an outer cylindrical element 210, a cross hair element 212, and an inner cylindrical element 214 that are integrally formed with one another and with the base element 208. The outer cylindrical element 210 presents internal and external sighting surfaces 216,218. The inner cylindrical element 214 presents internal and external sighting surfaces 220,222. The cross hair element 212 presents sighting surface 224.

The breech sight 204 includes a base 226, a cylindrical body 228, and a spirit level 230. The base 226 comprises a platform portion 232, a dovetail portion 234 that projects below the platform portion 232 and interlocks with the complemental dovetail groove D, and a stem portion 236 that supports the cylindrical body 228. The cylindrical body 228 is unitary and presents internal and external sighting surfaces 238,240. The base 226 presents sighting surfaces 242. When a target is viewed along the sighting direction, the sighting surfaces 216,224,240,242 preferably cooperatively form a plurality of outer aiming windows 244 and sighting surfaces 222,224,238 preferably cooperatively form a plurality of inner aiming windows 246. Muzzle sight 202 presents a central aiming window 248.

Figure 10:
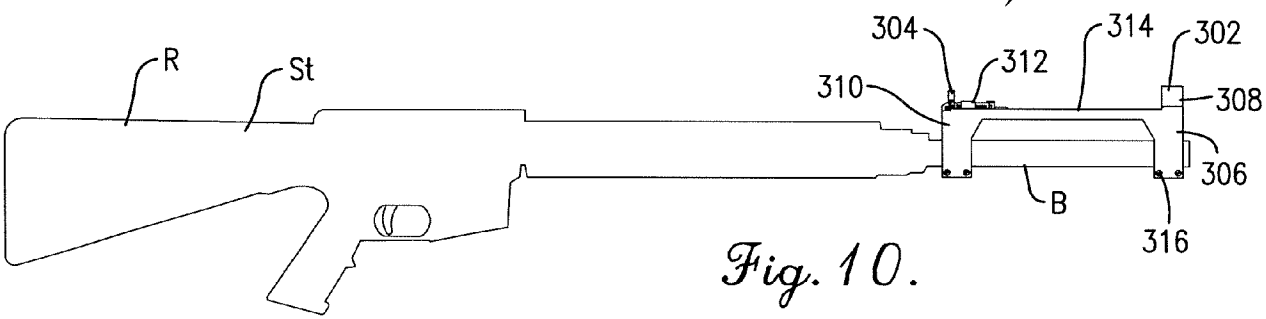
FIG. 10 is a side elevational view of a sighting assembly constructed in accordance with a third embodiment of the present invention and shown mounted on the barrel of a rifle (illustrated schematically)

Turning to FIG. 10, an alternative sighting assembly 300 is constructed in accordance with a third embodiment of the present invention. In the illustrated embodiment, a rifle R includes a stock St and a barrel B. The sighting assembly 300 broadly includes distal and proximal sights 302,304. The distal sight 302 includes abase 306 and a cylindrical body 308. The proximal sight 304 includes a base 310 and a dual sight 312 shiftably mounted to the base 310. The bases 306, 310 are integrally formed with a bridging element 314 and are thereby fixed to one another. The bases 306,310 are attached to the barrel B with fasteners 316. The illustrated sighting assembly 300 is mounted on the barrel B adjacent a distal end Ed. With a butt end of the stock St positioned against the user's shoulder and the sighting assembly 300 spaced adjacent the distal end Ed, the sight relief distance is preferably about 18 inches. However, the principles of the present invention are applicable where the sight relief distance is greater or lesser than 18 inches.

Figure 11:
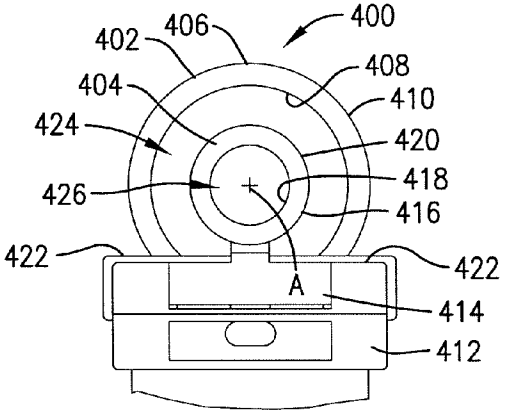
FIG. 11 is a rear elevational view of a sighting assembly constructed in accordance with a fourth embodiment of the present invention and shown mounted on a handgun (shown in fragmentary) and illustrating a sight picture provided when viewing the sighting assembly along a sighting direction in order to aim the handgun at a target (not shown)

Turning to FIG. 11, an alternative sighting assembly 400 is constructed in accordance with a fourth embodiment of the present invention. The sighting assembly 400 broadly includes distal and proximal sights 402,404. The distal sight 402 includes a cylindrical body 406 with internal and external sighting surfaces 408,410. The proximal sight 404 includes a base 412 and a sight 414 with a cylindrical body 416. The cylindrical body 416 presents internal and external sighting surfaces 418,420 and the base 412 presents sighting surfaces 422. In the illustrated embodiment, the sights 402,404 have central axes that are coaxial with a sighting axis A. When a target is viewed along the sighting axis A, the sighting surfaces 408,420,422 cooperatively define an outer aiming window 424. Sighting surface 418 defines an inner aiming window 426.

Figure 12:
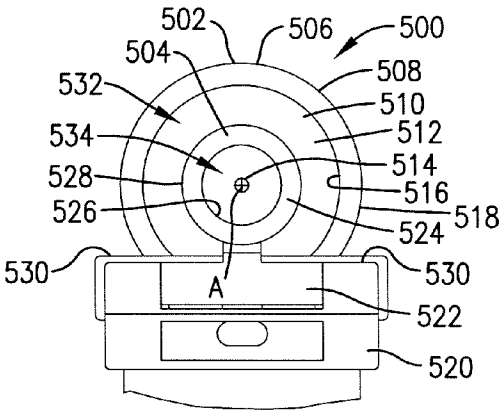
FIG. 12 is a rear elevational view of a sighting assembly constructed in accordance with a fifth embodiment of the present invention and shown mounted on a handgun (shown in fragmentary) and illustrating a sight picture provided when viewing the sighting assembly along a sighting direction in order to aim the handgun at a target (not shown)

Turning to FIG. 12, an alternative sighting assembly 500 is constructed in accordance with a fifth embodiment of the present invention. The sighting assembly 500 broadly includes distal and proximal sights 502,504. The distal sight 502 includes a cylindrical body 506 with an outer circular element 508 and an inner element 510. The inner element 510 includes a transparent element 512 with a dot 514 centrally positioned thereon, such that the inner element 510 comprises a reticle. The circular element 508 presents internal and external sighting surfaces 516,518. The proximal sight 504 includes a base 520 and a sight 522 with a cylindrical body 524. The cylindrical body 524 presents internal and external sighting surfaces 526,528 and the base 520 presents sighting surfaces 530. In the illustrated embodiment, the sights 502, 504 have central axes that are coaxial with a sighting axis A. When a target is viewed along the sighting axis A, the sighting surfaces 516,528,530 cooperatively define an outer aiming window 532, and sighting surface 526 and dot 514 cooperatively define an inner aiming window 534.

Figure 13:
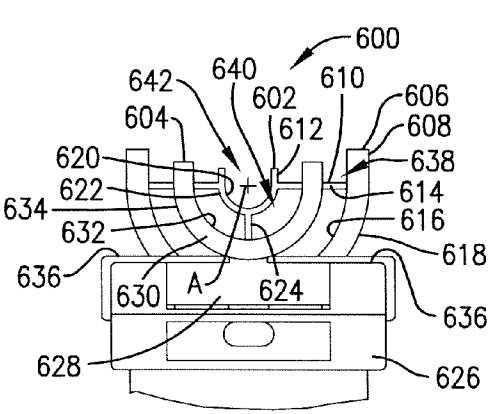
FIG. 13 is a rear elevational view of a sighting assembly constructed in accordance with a sixth embodiment of the present invention and shown mounted on a handgun (shown in fragmentary) and illustrating a sight picture provided when viewing the sighting assembly along a sighting direction in order to aim the handgun at a target (not shown)

Turning to FIG. 13, an alternative sighting assembly 600 is constructed in accordance with a sixth embodiment of the present invention. The sighting assembly 600 broadly includes distal and proximal sights 602,604. The distal sight 602 includes a body 606 including an outer semicylindrical element 608 and an inner element 610 with a semicylindrical portion 612 and a cross hair portion 614. The outer semicylindrical element 608 presents internal and external sighting surfaces 616,618. The semicylindrical portion 612 presents internal and external sighting surfaces 620,622. The cross hair portion 614 presents sighting surfaces 624. The proximal sight 604 includes a base 626 and a sight 628 with a semicylindrical body 630. The semicylindrical body 630 presents internal and external sighting surfaces 632,634 and the base 626 presents sighting surfaces 636. In the illustrated embodiment, the sights 602,604 have central axes that are coaxial with a sighting axis A. When a target is viewed along the sighting axis A, the sighting surfaces 616,624,634,636 cooperatively define outer aiming windows 638, and sighting surfaces 622,624,632 cooperatively define inner aiming windows 640. The internal sighting surface 620 defines a central opening 642.

Figure 14:
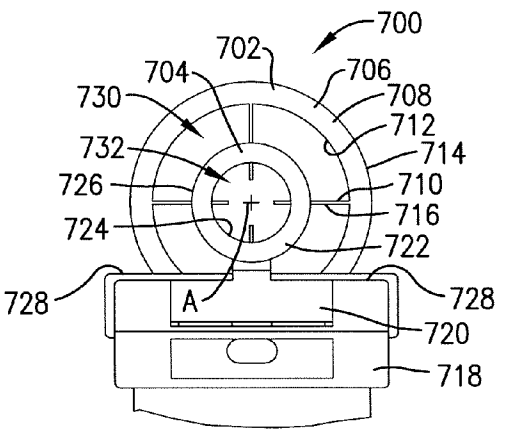
FIG. 14 is a rear elevational view of a sighting assembly constructed in accordance with a seventh embodiment of the present invention and shown mounted on a handgun (shown in fragmentary) and illustrating a sight picture provided when viewing the sighting assembly along a sighting direction in order to aim the handgun at a target (not shown)

Turning to FIG. 14, an alternative sighting assembly 700 is constructed in accordance with a seventh embodiment of the present invention. The sighting assembly 700 broadly includes distal and proximal sights 702,704. The distal sight 702 includes a body 706 including an outer cylindrical element 708 and inner cross hair elements 710. The outer cylindrical element 708 presents internal and external sighting surfaces 712,714. The cross hair elements 710 present sighting surfaces 716. The proximal sight 704 includes a base 718 and a sight 720 with a cylindrical body 722. The cylindrical body 722 presents internal and external sighting surfaces 724,726 and the base 718 presents sighting surfaces 728. In the illustrated embodiment, the sights 702,704 have central axes that are coaxial with a sighting axis A. When a target is viewed along the sighting axis A, the sighting surfaces 712, 716,726,728 cooperatively define outer aiming windows 730, and sighting surfaces 724,716 cooperatively define an inner aiming window 732, with the cross hair elements 710 extending within the surface 724 but being spaced from the axis A.

Turning to FIG. 15, an alternative sighting assembly 800 is constructed in accordance with a eighth embodiment of the present invention. The sighting assembly 800 broadly includes distal and proximal sights 802,804. The distal sight 802 includes a body 806 including an outer cylindrical element 808 and interconnected inner cross hair elements 810. The outer cylindrical element 808 presents internal and external sighting surfaces 812,814. The cross hair elements 810 present sighting surfaces 816. The proximal sight 804 includes a base 818 and a sight 820 with a cylindrical body 822. The cylindrical body 822 presents internal and external sighting surfaces 824,826 and the base 818 presents sighting surfaces 828. In the illustrated embodiment, the sights 802, 804 have central axes that are coaxial with a sighting axis A. When a target is viewed along the sighting axis A, the sighting surfaces 812,816,826,828 cooperatively define outer aiming windows 830, and sighting surfaces 824,816 cooperatively define inner aiming windows 832.

Turning to FIG. 16, an alternative sighting assembly 900 is constructed in accordance with a ninth embodiment of the present invention. The sighting assembly 900 broadly includes distal and proximal sights 902,904. The distal sight 902 includes a body 906 including an outer cylindrical element 908, inner cross hair elements 910, and a triangular tube element 912 having a substantially triangular cross section. The outer cylindrical element 908 presents internal and external sighting surfaces 914,916. The cross hair elements 910 present sighting surfaces 918. The triangular tube element 912 presents internal and external sighting surfaces 920,922. The proximal sight 904 includes a base 924 and a sight 926 with a triangular tube body 928 having a substantially triangular cross section. The triangular tube body 928 presents internal and external sighting surfaces 930,932 and the base 924 presents sighting surfaces 934. In the illustrated embodiment, the sights 902,904 have central axes that are coaxial with a sighting axis A. When a target is viewed along the sighting axis A, the sighting surfaces 914,918,932,934 cooperatively define outer aiming windows 936, and sighting surfaces 918,922,930 cooperatively define inner aiming windows 938. Internal sighting surface 920 defines a central aiming window 940.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A method of aiming a handheld firearm at a target with proximal and distal sights, said method comprising the steps of:

(a) holding the firearm at a sight relief distance between the user and the proximal sight equal to or greater than about 18 inches;

(b) sighting the target with the proximal and distal sights so that the proximal and distal sights cooperatively present a sight picture, with the sight picture including generally inner and outer windows, said proximal sight presenting a generally inward facing proximal sighting surface and a generally outward facing proximal sighting surface, said distal sight including inner and outer elements, said outer element presenting a generally inward facing distal sighting surface, with the inward facing distal sighting surface and outward facing proximal sighting surface cooperatively forming the outer window, said inner element presenting a generally outward facing distal sighting surface, with the outward facing distal sighting surface and inward facing proximal sighting surface cooperatively forming the inner window; and (c) positioning the firearm so that the window thickness dimension is substantially the same for both the inner and outer windows.

2. The method as claimed in claim 1, step (c) including the step of positioning the firearm so that the window thickness dimension is shorter than a window length dimension.

3. The method as claimed in claim 1, said surfaces being substantially circular such that each window has a substantially annular shape, step (c) including the step of positioning the firearm so that the aiming windows are substantially concentric with one another.

4. The method as claimed in claim 1, at least one of said inner and outer windows comprising a plurality of aiming windows for aiming at the target, step (c) including the step of positioning the firearm so that the aiming windows are substantially symmetrical with one another.

5. The method as claimed in claim 1, step (a) including the step of positioning the butt end of the firearm stock against the shoulder of the user.

6. The method as claimed in claim 1; and (d) viewing a spirit level that indicates orientation of the firearm to the user.

* * * * *